US010068505B2

(12) United States Patent
Vaysman

(10) Patent No.: US 10,068,505 B2
(45) Date of Patent: Sep. 4, 2018

(54) IDENTIFICATION TAG WITH MECHANICAL ACTUATOR

(71) Applicant: Aintu Inc., Sunnyvale, CA (US)

(72) Inventor: Arthur Vaysman, San Jose, CA (US)

(73) Assignee: Aintu Inc., Sunnyvale, CA (US)

( * ) Notice: Subject to any disclaimer, the term of this patent is extended or adjusted under 35 U.S.C. 154(b) by 0 days.

(21) Appl. No.: 15/636,355

(22) Filed: Jun. 28, 2017

(65) Prior Publication Data

US 2017/0372648 A1 Dec. 28, 2017

Related U.S. Application Data

(60) Provisional application No. 62/355,827, filed on Jun. 28, 2016.

(51) Int. Cl.
*G09F 19/00* (2006.01)

(52) U.S. Cl.
CPC ..... *G09F 19/00* (2013.01)

(58) Field of Classification Search
CPC ..... G09F 19/00
See application file for complete search history.

(56) References Cited

U.S. PATENT DOCUMENTS 4,920,674 A * 5/1990 Shaeffer ..... A63H 27/10 116/210
5,083,771 A * 1/1992 Tyner ..... A63H 27/10 116/DIG. 9
5,311,834 A * 5/1994 Ross ..... A63F 3/065 116/234
5,852,889 A * 12/1998 Rinaldi ..... B42D 15/045 40/124.06
6,539,654 B2 * 4/2003 Lin ..... F21S 10/002 40/406
7,836,619 B2 * 11/2010 Coutts ..... G09F 17/00 40/218
2013/0000163 A1 * 1/2013 Bandow ..... B42D 15/027 40/124.01

* cited by examiner

*Primary Examiner* — Gary C Hoge
(74) *Attorney, Agent, or Firm* — H M Law Goroup LLP; Vani Moodley, Esq.

(57) ABSTRACT

An identification tag comprising a display and a mechanical actuator is disclosed. A visual indication associated with a manufacturer is displayed by a display. The mechanical actuator comprises a reservoir to contain a fluid component. The mechanical actuator is connected to the display via a conduit.

7 Claims, 2 Drawing Sheets

IDENTIFICATION TAG WITH MECHANICAL ACTUATOR

TECHNICAL FIELD

Various implementations relate generally to labels or tags used in manufactured goods.

BACKGROUND OF THE INVENTION

Manufactured goods are labeled or tagged for the purpose of tracking and management of goods. The manufactured goods are supplied to the whole seller by the manufacturers in bulk quantities. At every level, manufacturer, whole seller or retailer goods are labeled and tagged for the purpose of tracking. Various conventional tracking and labeling methods are used which are either automated or semi-automated. By using effective tracking methods, the goods are transported or transferred efficiently and safely from one place to another. However, there are certain goods which are difficult to track or label and counterfeiting of such goods is easily possible. Therefore, an efficient and secure technique is required for labeling and tracking to overcome this problem.

SUMMARY

This Summary is provided to comply with 37 C.F.R. § 1.73, requiring a summary of the present technology briefly indicating the nature and substance of the present technology. It is submitted with the understanding that it will not be used to interpret or limit the scope or meaning of the claims.

In one embodiment, an identification tag is provided for a manufactured product. The identification tag may include a display component and a mechanical actuator. The mechanical actuator may include a reservoir for containing fluid component. The display component may be in fluid communication with the mechanical actuator. The fluid component may be transferred to the display component via a conduit. The display component may include a visual indication associated with a manufacturer of the product.

In use, the mechanical actuator component may be actuated which may drive at least a portion of the fluid component into the display component. Advantageously, the driving of fluid into the display component causes a visual change of the display component. The visual change may serve as a confirmation of the authenticity of the product associated with the identification tag.

In an embodiment, the color of the display component may change due to the transfer of fluid component from the reservoir. In another embodiment, the display component may include an inflatable component similar to but not limited to a balloon. The display component may get inflated when the fluid is transferred to the display component from the mechanical actuator.

In an embodiment, the fluid transferred to the display may return to the reservoir after a period of time. In an embodiment, the fluid transferred to the display may return to the reservoir after 30 seconds.

In an embodiment, the fluid may be a gel or any liquid known in the art which may change the visual characteristics of the display component. Other aspects of the invention will be apparent from the detailed description below.

BRIEF DESCRIPTION OF THE FIGURES

For a more complete understanding of example embodiments of the present technology, reference is now made to the following descriptions taken in connection with the accompanying drawings in which.

DETAILED DESCRIPTION OF THE INVENTION

In the following description, for purposes of explanation, numerous specific details are set forth in order to provide a thorough understanding of the invention. It will be apparent, however, to one skilled in the art that the invention can be practiced without these specific details. In other instances, structures and devices are shown in block or flow diagram form only in order to avoid obscuring the invention.

Reference in this specification to "one embodiment" or "an embodiment" means that a particular feature, structure, or characteristic described in connection with the embodiment is included in at least one embodiment of the invention. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Moreover, although the following description contains many specifics for the purposes of illustration, anyone skilled in the art will appreciate that many variations and/or alterations to the details are within the scope of the present invention. Similarly, although many of the features of the present invention are described in terms of each other, or in conjunction with each other, one skilled in the art will appreciate that many of these features can be provided independently of other features. Accordingly, this description of the invention is set forth without any loss of generality to, and without imposing limitations upon, the invention.

Figure 1:
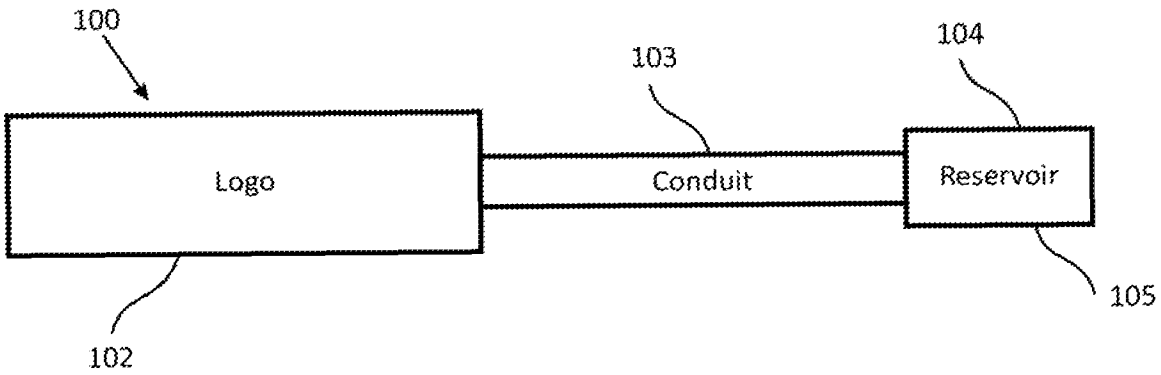
FIG. 1 illustrates the construction of an identification tag, in accordance with one embodiment of the invention

According to FIG. 1, a schematic drawing of an identification tag 100 is provided, in accordance with one embodiment of the invention. The identification tag 100 comprises a display component 102. The display component 102 bears a logo, or other visual indicia which may be associated with a particular brand or manufacturer. The display component 102 is communicatively coupled to a mechanical actuator component 104 by means of a conduit 106. The mechanical actuator component 104 may define a reservoir 108, in accordance with one embodiment of the invention.

The reservoir 108 may be partially filled with a fluid, such as but not limited to a gel. In use, the reservoir 108 may have a slight bulge which is caused by the presence of the fluid therein. For purposes of mechanical actuation, when the reservoir bulge is depressed by a human finger, the mechanical force applied may drive the fluid within the reservoir 108 at least partially into the display component 102 via the conduit 106. Introduction of the fluid from the reservoir 106 into the display component 102 as described above, advantageously causes a change in the visual characteristics of the display component 102. For example, in one embodiment the display component 102 may be at least partially inflatable akin to a balloon through the introduction of the fluid. Thus, the display component 102 may be balloon-like in construction to facilitate expansion under influence of the fluid. When such expansion occurs, there may be a color change associated with the material out of which the display component is constructed. For example, due to expansion through the introduction of the fluid, the material (rubber or polyurethane) may become stretched and hence more transparent. Further, the introduction of the fluid itself, in some embodiments, may exhibit certain color characteristics and may further cause a change in the appearance of the logo contained in the display component 102. The change in the appearance of the logo, if it correlates with the usual appearance of said logo already known to a consumer provides an indication of the authenticity of the product with which the identification tag is associated.

In one embodiment, the identification tag 100 may be adapted so that post actuation of the reservoir 106, as described above, the fluid that was displaced into the conduit 106 and the display component 102 may return to the reservoir 108 after a certain period of time so that the identification tag 100 may be actuated by another customer. In one embodiment, this period of time maybe 30 seconds. Also, the periods of time possible may depend on the viscosity of the fluid, as well as the mechanical properties of the conduit 106.

Figure 2:
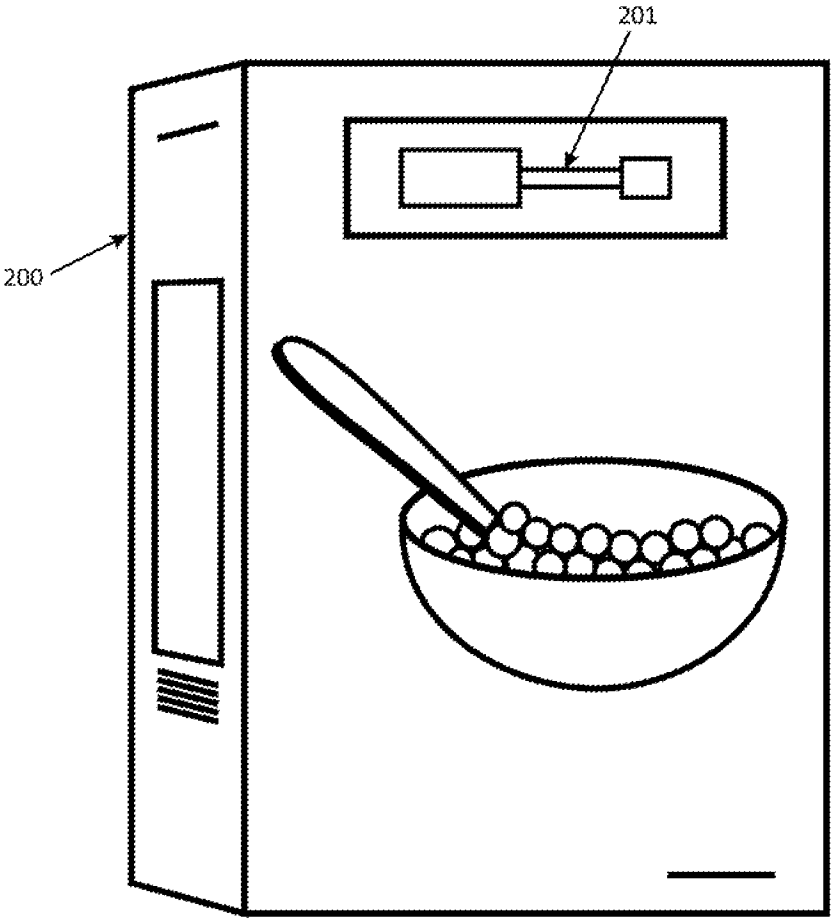
FIG. 2 shows a product package bearing the identification tag, in accordance with one embodiment of the invention.

FIG. 2 shows a product package 200 associated with a cereal manufacturer which includes the identification tag 100.

Also, techniques, devices, subsystems and methods described and illustrated in the various embodiments as discrete or separate may be combined or integrated with other systems, modules, techniques, or methods without departing from the scope of the present technology. Other items shown or discussed as directly coupled or communicating with each other may be coupled through some interface or device, such that the items may no longer be considered directly coupled with each other but may still be indirectly coupled and in communication, whether electrically, mechanically, or otherwise, with one another. Other examples of changes, substitutions, and alterations ascertainable by one skilled in the art, upon or subsequent to studying the exemplary embodiments disclosed herein, may be made without departing from the spirit and scope of the present technology.

It should be noted that reference throughout this specification to features, advantages, or similar language does not imply that all of the features and advantages should be or are in any single embodiment. Rather, language referring to the features and advantages may be understood to mean that a specific feature, advantage, or characteristic described in connection with an embodiment may be included in at least one embodiment of the present technology. Thus, discussions of the features and advantages, and similar language, throughout this specification may, but do not necessarily, refer to the same embodiment.

Various embodiments of the present disclosure, as discussed above, may be practiced with steps and/or operations in a different order, and/or with hardware elements in configurations which are different than those which are disclosed. Therefore, although the technology has been described based upon these exemplary embodiments, it is noted that certain modifications, variations, and alternative constructions may be apparent and well within the spirit and scope of the technology. Although various exemplary embodiments of the present technology are described herein in a language specific to structural features and/or methodological acts, the subject matter defined in the appended claims is not necessarily limited to the specific features or acts described above. Rather, the specific features and acts described above are disclosed as exemplary forms of implementing the claims.

The invention claimed is:

1. An identification tag comprising:

a display for displaying a visual indication associated with a manufacturer;

a mechanical actuator connected to the display via a conduit, wherein the mechanical actuator comprises a reservoir in order to contain a fluid, and wherein the visual characteristics of the display on receiving the fluid from the reservoir changes, wherein the fluid transferred to the display returns to the reservoir after a predefined period of time.

2. The identification tag of claim 1, wherein the fluid contained in the reservoir is transferred to the display via the conduit on application of pressure.

3. The identification tag of claim 2, wherein the display is inflated when the fluid is transferred from the reservoir to the display.

4. The identification tag of claim 2, wherein color of the display changes when the fluid is transferred from the reservoir to the display.

5. The identification tag of claim 1, wherein the predefined period of time is 30 seconds.

6. An identification system comprising:

an identification tag including a display for displaying a visual indication associated with a manufacturer;

a mechanical actuator connected to the display via a conduit, wherein the mechanical actuator comprises a reservoir in order to contain a fluid, wherein the fluid contained in the reservoir is transferred to the display via the conduit on application of pressure, wherein the visual characteristics of the display on receiving the fluid from the reservoir changes, wherein the fluid transferred to the display returns to the reservoir after a predefined period of time.

7. The identification system of claim 6, wherein the predefined period of time is 30 seconds.

* * * * *